United States Patent [19]

Davis

[11] 4,106,535

[45] Aug. 15, 1978

[54] APPARATUS FOR FILLING THE CELLS OF AN EXPANDED CELLULAR CORE MEMBER WITH GRANULAR INSULATION

[75] Inventor: Bernard Harpley Davis, Stoney Creek, Canada

[73] Assignee: H. H. Robertson Company, Pittsburgh, Pa.

[21] Appl. No.: 660,014

[22] Filed: Feb. 23, 1976

[51] Int. Cl.[2] ..... B65B 1/04

[52] U.S. Cl. ..... 141/88; 141/125; 141/129; 141/392; 222/352

[58] Field of Search ..... 141/129, 80, 280, 125, 141/183–191, 392, 86, 87, 88, 126; 222/352, 284

[56] References Cited

U.S. PATENT DOCUMENTS

| | | | |
|---|---|---|---|
| 51 | 4/1842 | Bachelder et al. | 222/352 |
| 513,940 | 1/1894 | Kelly | 222/352 |
| 652,581 | 6/1900 | Ayars | 141/125 |
| 1,106,686 | 8/1914 | Swarovski et al. | 222/352 |
| 2,527,960 | 10/1950 | Rapp | 222/352 |
| 2,728,510 | 12/1955 | Dunnican et al. | 141/125 |
| 3,265,251 | 8/1966 | Lense | 222/352 |
| 3,267,972 | 8/1966 | Thompson | 141/80 |

FOREIGN PATENT DOCUMENTS

| | | | |
|---|---|---|---|
| 191,240 | 1/1923 | United Kingdom | 222/352 |

*Primary Examiner*—Houston S. Bell
*Attorney, Agent, or Firm*—Harry B. Keck; George E. Manias

[57] ABSTRACT

Apparatus for filling the cells of an expanded cellular core member with granular insulation. The core member may be secured to a base sheet thereby capping lower ends of the cells and may have a film of adhesive material on upper ends of the cells. The apparatus includes hopper means having a lower discharge opening therein, and conveyor means arranged to transport the core member along a rectilinear path of travel, past the discharge opening. Adjustable barrier means is provided for adjusting the cross-sectional area of the discharge opening. Valve means controls the flow of granular insulation through the discharge opening into the core cells. Brush means positioned downstream of the discharge opening removes excess granular insulation from the cells and renders the film of adhesive material substantially entirely free of the granular insulation. Pan means is positioned to receive excess granular insulation from the core member.

14 Claims, 14 Drawing Figures

49
29
27
39B
35
20
78
76
77
52
50
32
58
57
55
54
56
53
25
31
69
60
75
74
63
65
18
P-2
19A
17
26
16
28
37
33
P-1
64
67
68
66

APPARATUS FOR FILLING THE CELLS OF AN EXPANDED CELLULAR CORE MEMBER WITH GRANULAR INSULATION

BACKGROUND OF THE INVENTION

1. Field of the Invention

This invention relates to apparatus for filling the cells of an expanded cellular core member with granular insulation, and more particularly to improvements in such apparatus.

2. Description of the Prior Art

Expanded cellular core members, such as honeycomb core members, are used extensively in building panels in the form of sandwiches wherein facing sheets are bonded by glue layers to the opposite faces of the honeycomb core member. See for example U.S. Pat. Nos. 2,556,470 (DEL MAR); 2,839,442 (WHITAKER); 2,849,758 (PLUMLEY et al); 2,893,076 (HERTS); 2,911,076 (SAUNDERS et al); 3,817,810 (RONAN et al). Honeycomb sandwiches exhibit poor thermal insulating and sound attenuating characteristics. To improve these characteristics, the cells of the honeycomb core have been filled with materials, such as a compressed fibrous and resin-containing mixture, see U.S. Pat. Nos. 3,630,813 (ALLEN); 3,733,229 (SCHEER et al); or with granular insulation, such as perlite, see SAUNDERS et al, supra; and copending U.S. patent applications Ser. No. 601,296 (FRANDSEN) and Ser. No. 601,342 (ANDERSON) both filed Aug. 4, 1975, now U.S. Pat. Nos. 3,998,024 and 3,998,023 respectively and both assigned to the assignee of this invention.

Where a film of adhesive material is provided on the upper ends of the cells prior to filling the cells with insulation, a reliable final bond between the facing sheet and the core member can only be achieved if the film of adhesive and the surface to which the adhesive is subsequently adhered is substantially entirely free of the insulation. After the cells have been filled, rendering the film of adhesive substantially entirely free of insulation while maintaining the cells uniformly filled is difficult to achieve. The friability of granular insulations, in particular perlite, is bothersome.

SUMMARY OF THE INVENTION

The principal object of this invention is to provide improvements in apparatus for automatically filling the cells of an expanded cellular core member with granular insulation.

A further object of this invention is to provide improvements in apparatus of the type described by which the cells may be uniformly filled.

Still another object of this invention is to provide improvements in apparatus of the type described in which the upper surface of a film of adhesive material provided on the upper ends of the cells is rendered substantially entirely free of granular insulation.

The present invention provides improvements in apparatus for filling cells of an expanded cellular core member with granular insulation, wherein the core member has a base sheet secured to and capping lower ends of the cells, and has a film of adhesive material provided on the upper ends of the cells. The apparatus includes horizontally disposed conveyor means arranged to transport the core member along a rectilinear path of travel, and hopper means positioned above the conveyor means and having a lower discharge opening therein proximate to the conveyor means.

In accordance with the present invention, adjustable barrier means is provided for adjusting the cross-sectional area of the discharge opening, whereby the length of the discharge opening is adjusted to correspond to the width of the core member. Valve means controls the flow of granular insulation through the discharge opening. Valve operating means and cooperating control means responsive to the passage of the core member, opens and closes the valve means. Horizontal pan means disposed beneath a conveyor means receives excess granular insulation from the core member. A recovery system is provided by which the excess granular insulation accumulated in the horizontal pan means is recovered for reintroduction into the hopper means. The recovery means also includes filter means by which granular insulation in the form of fines is recovered for disposal.

Further in accordance with the present invention, brush means is positioned downstream of the discharge opening and extends transversely of the core member. The brush means removes excess granular insulation from the core member such that the cells thereof are uniformly filled, and renders the film of adhesive material substantially entirely free of the granular insulation. Drive means is provided for oscillating the brush means transversely of the core member.

DESCRIPTION OF THE PREFERRED EMBODIMENT(S)

Figure 1:
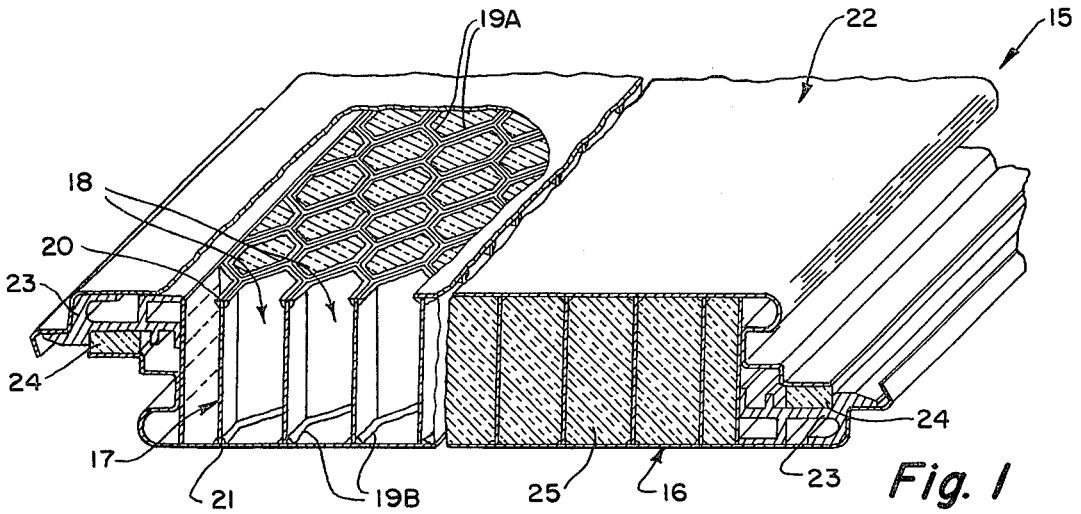
FIG. 1 is a broken, fragmentary isometric view of a building panel.

FIG. 1 illustrates a panel 15 comprising a base or facing sheet 16; an expanded cellular core member or honeycomb core member 17 having plural open-ended cells 18 and having films 19A, 19B of adhesive material applied to the upper and lower ends 20, 21 of the cells 18; and a top or facing sheet 22. Each of the sheets 16, 22 is provided with a side rail 23 and an isolation strip 24 interposed between the side rail 23 and the adjacent sheet. The isolation strip 24 thermally insulates the facing sheets from each other. To increase the thermal insulating and acoustical absorption qualities of the panel 15, granular insulation 25 is provided in the cells 18.

Figure 2:
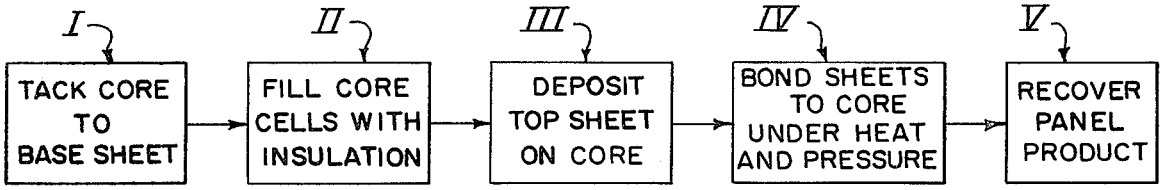
FIG. 2 is a diagrammatic illustration of a method of fabricating the panel of FIG. 1.

A method of manufacturing the panel 15 is diagrammatically illustrated in FIG. 2. The method includes the steps of: I. tacking the honeycomb core 17 to the base sheet 16; II. filling the core cells 18 with granular insulation 25; III. depositing the top sheet 22 on the core 17 thereby capping the cells 18 thereof; IV. bonding (curing the films 19 of adhesive material) the sheets 16, 22 to the core member 17 under heat and pressure; and V. thereafter recovering the panel 15 as a product.

It will be appreciated that in order to provide a uniform thermal insulating value throughout the panel 15, the cells 18 should be uniformly and substantially entirely filled with insulating material 25.

It will also be appreciated that the soundness and extent of the adhesive bonds between the core 17 and the facing sheets 16, 22 affect the structural integrity of the building panel 15. That is, where less than all of the core ends 20, 21 are bonded to the facing sheets 16, 22, the structural effectiveness of the building panel 15 is impaired. Thus after filling the core cells 18, any quantity of the insulation 25 presented between the film 19A of adhesive material and the facing sheet 22 will preclude a reliable final bond therebetween.

The present invention provides improved apparatus for uniformly filling the core cells 18 with insulation 25 and rendering the film 19A of adhesive material substantially entirely free of the granular insulation 25. The present apparatus is adapted to receive a core/sheet unit 26 (FIGS. 6 and 7) wherein the core member 17 is secured to the facing sheet 16.

Referring to FIGS. 3, 4, 6 and 7, the present apparatus 27 includes, in general, horizontally disposed conveyor means 28 arranged to transport the core/sheet unit 26 along a horizontal rectilinear path of travel. Hopper means 29 positioned above the conveyor means 28 includes an inlet opening 30 through which the granular insulation 25 (FIG. 7) is introduced therein, and a lower discharge opening 31 proximate to the conveyor means 28. Adjustable barrier means 32 (FIG. 7) is provided for adjusting the cross-sectional area of the discharge opening 31 in a manner hereinafter to be described. Valve means 33 controls the flow of granular insulation 25 through the discharge opening 31. Valve operating means 34 is provided for opening and closing the valve means 33 as desired. Brush means 35 positioned downstream of the discharge opening 31 removes excess granular insulation 25 from the cells 18 and renders the film 19A (FIG. 7) substantially entirely free of the granular insulation. Brush drive means 36 oscillates the brush means 35 transversely across the top of the core member 17. Horizontal pan means 37 receives excess granular insulation from the core member 17. Side plates 39A, 39B support the hopper means 29 and the brush means 35 in spaced-apart relation relative to the conveyor means 28. Adjusting means 40 supporting the side plates 39A, 39B on the conveyor means 28 provides adjustment in the level of the discharge opening 31 and of the brush means 35 relative to the conveyor means 28.

CONVEYOR MEANS 28

Figure 3:
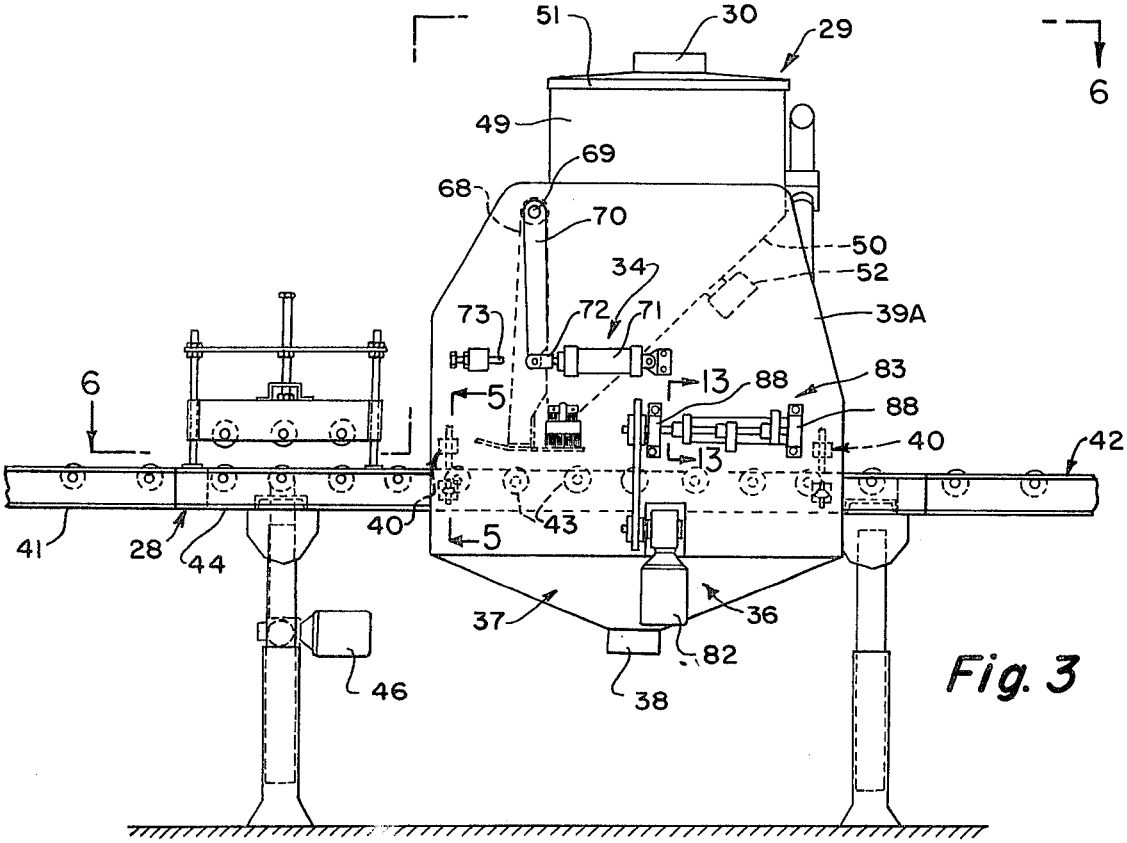
FIG. 3 is a side elevation view of the apparatus of this invention.
Figure 4:
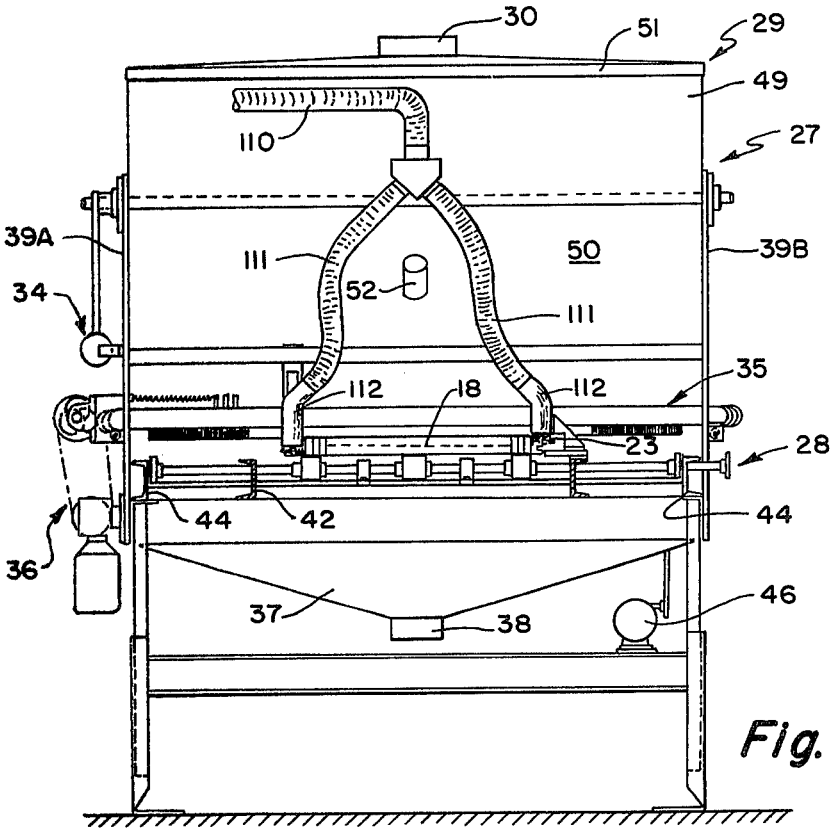
FIG. 4 is an end view, as seen from the line 4—4 of FIG. 6, further illustrating the apparatus of FIG. 3.
Figure 6:
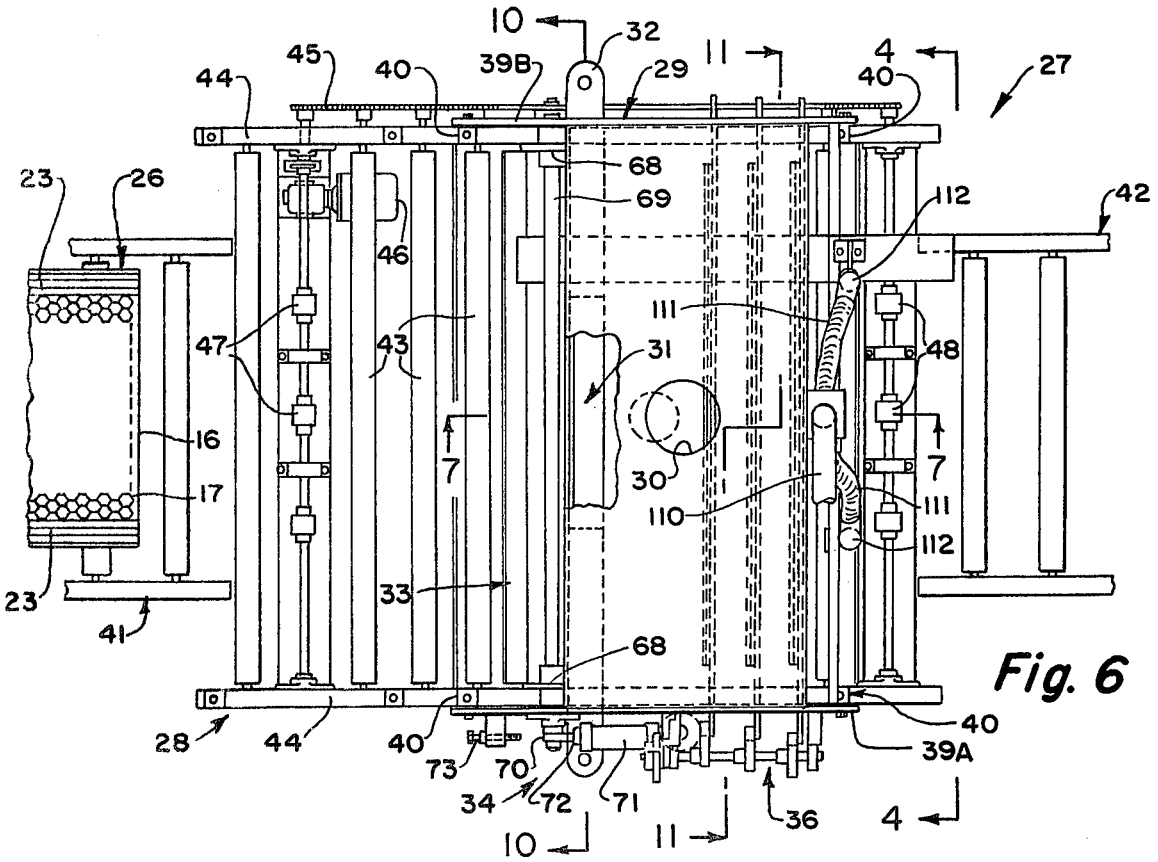
FIG. 6 is a plan view, partly in cross-section, as seen from the line 6—6 of FIG. 3.

Referring to FIGS. 3, 4 and 6, the core/sheet unit 26 is conveyed to and carried away from the apparatus 27 by feed and discharge conveyors 41, 42. The conveyor means 28 includes plural rollers 43 extending between frame members 44 and drivingly connected at common ends by a drive chain 45 (FIG. 6). Variable speed motor means 46 rotates the rollers 43 at the desired speed. Driven magnetic rolls 47, 48 are provided at the opposite ends of the conveyor means 28 to assist in moving the core/sheet unit 26 through the apparatus 27.

HOPPER MEANS 29

Figures 7, 8, 9:
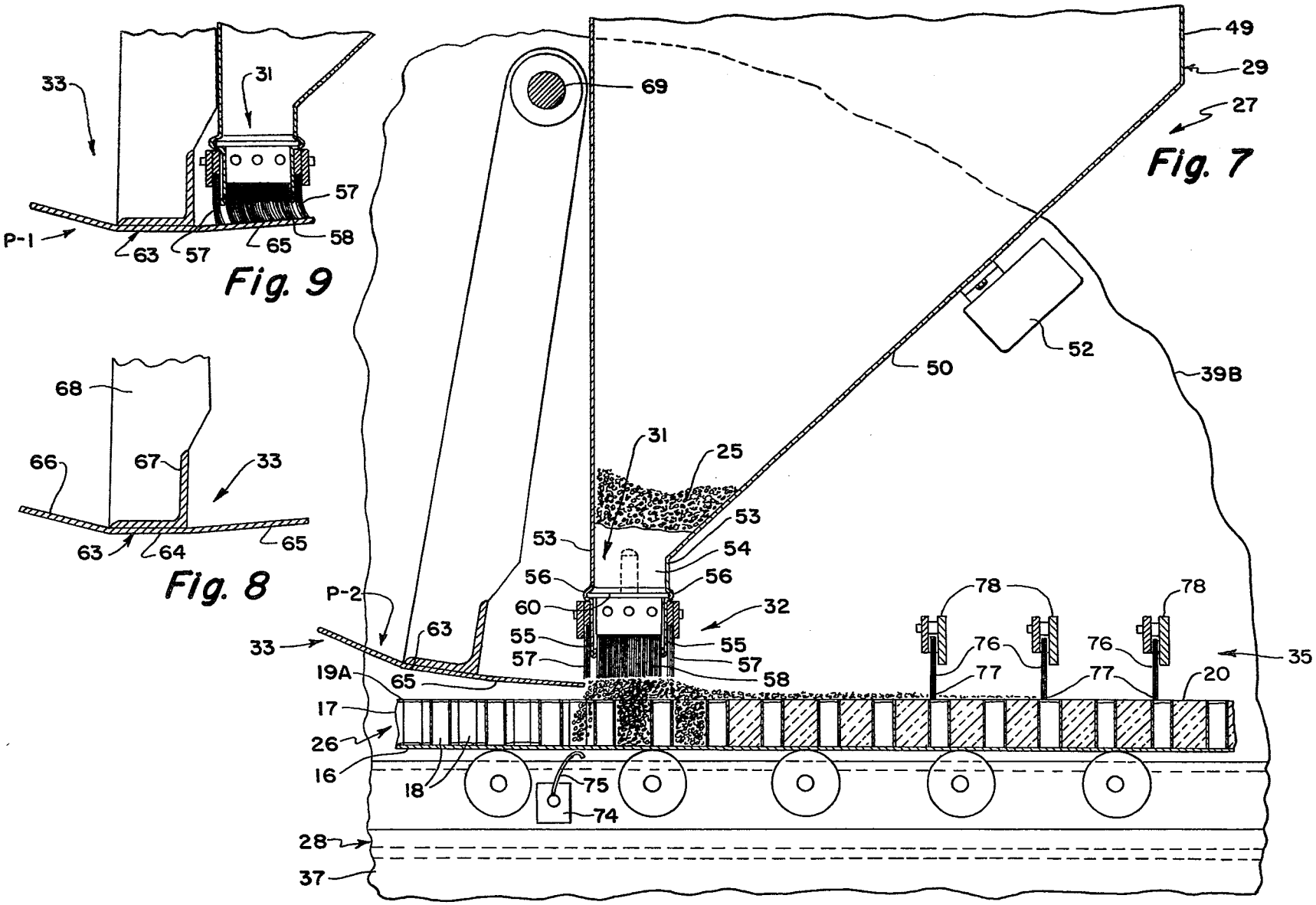
FIG. 7 is a fragmentary cross-sectional view taken along the line 7—7 of FIG. 6.
FIG. 8 is a fragmentary transverse cross-sectional view, illustrating valve means.
FIG. 9 is a fragmentary cross-sectional view, similar to FIG. 7, illustrating valve means disposed in capping relation with a hopper discharge opening.

Referring to FIGS. 3, 4 and 7, the hopper means 29 includes a hopper body 49 having an inclined rear wall 50 which directs the granular insulation 25 (FIG. 7) to the discharge opening 31; and a cap 51 (FIGS. 3 and 4) including the inlet opening 30. A vibrator 52 attached to the rear wall 50 prevents bridging of the granular insulation 25 and assures the free flow thereof to the discharge opening 31.

It will be observed in FIGS. 6 and 7 that the discharge opening 31 has a generally rectangular configuration including vertically presented opposite side walls 53 extending transversely of the conveyor means 28 and vertically presented opposite end walls 54. Vertically presented side wall extensions 55 extend downwardly from the opposite side walls 53 below the level of the opposite end walls 54. An outwardly convex bead 56 is formed in each of the side wall extensions 55. The beads 56 are parallel to each other and extend transversely of the side wall extensions and between the opposite end walls 54.

ADJUSTABLE BARRIER MEANS 32

Figure 10:
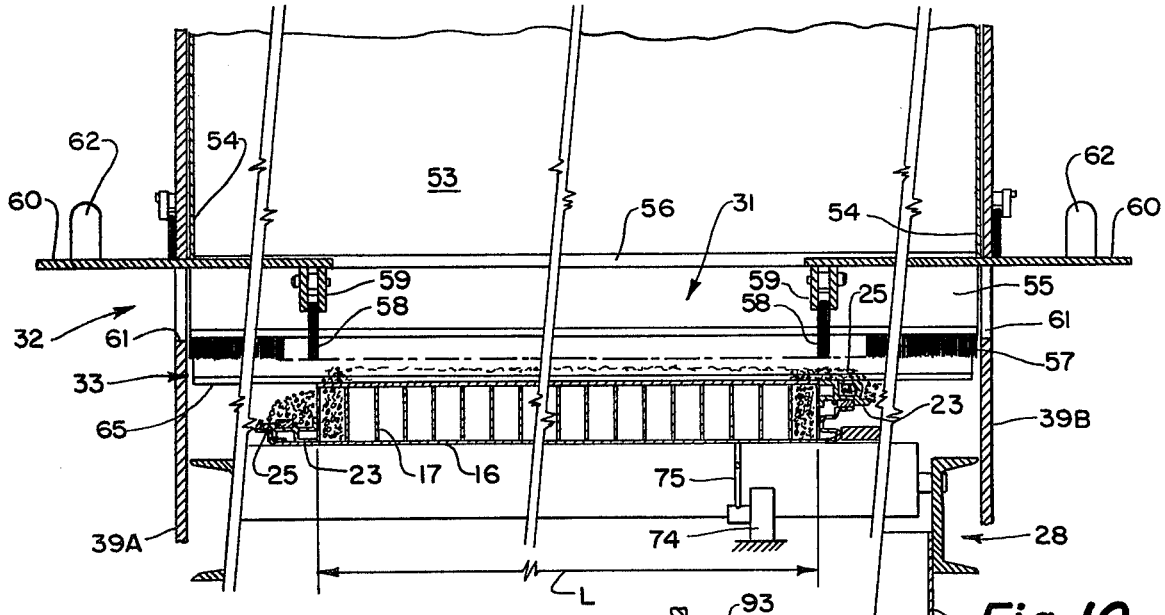
FIG. 10 is a broken, fragmentary cross-sectional view taken along the line 10—10 of FIG. 6.

Referring to FIGS. 7 and 10, the adjustable barrier means 32 may comprise fixed barrier members, such as brushes 57, one extending along the entire length of and downwardly from each of the opposite side walls 53; second barrier members, such as brushes 56, extending between the fixed barrier members 57 and downwardly from the discharge opening 31; and support means — the outwardly convex beads 56 — supporting each of the second barrier members 58 for horizontal movement toward and away from each other.

As best shown in FIG. 10, each of the second barrier members 58 is secured to a vertically presented plate 59 which, in turn, is secured to an end of a horizontally presented plate 60. The horizontally presented plates 60 have opposite longitudinal edges thereof slideably received in the outwardly convex beads 56, as best shown in FIG. 7.

Reverting to FIG. 10, each of the plates 60 extends through openings 61 provided in the side plates 39A, 39B. A handle 62 secured to the end of the plate 60 and presented outboard of the side plates 39A, 39B provides for adjusting the position of the second barrier members 58, whereby the length L of the discharge opening 31 may be rendered substantially coextensive with the width of the core member 17. That portion of the discharge opening 31 outboard of the second barrier members 58 is essentially sealed off by the plates 60.

VALVE MEANS 33

Referring to FIG. 8, the valve means 33 may comprise a plate 63 having a central portion 64 and leading and trailing edge portions 65, 66 which are inclined upwardly from the horizontal. The plate 63 is secured to an angle member 67 which has arms 68 (only one visible) secured to the opposite ends thereof. The leading edge portion 65 of the plate 63 (FIGS. 9 and 10) is at least coextensive in area with the discharge opening 31. Referring to FIGS. 3, 6 and 7, the upper ends of the arms 68 are secured to an axle 69 which extends between and is rotatably supported on the side plates 39A, 39B. As best shown in FIGS. 3 and 6, a lever arm 70 is connected at its upper end to the axle 69 and at its lower end to the valve operating means 34. The valve operating means 34 may comprise a pneumatically operated cylinder 71 having a piston rod 72. An adjustable stop 73 limits the stroke of the piston rod 72.

It will be observed by comparing FIGS. 3, 7 and 9 that the motor means 34 (FIG. 3) swings the valve means 33 between a first position P-1 (FIG. 9) and a second position P-2 (FIG. 7). In the first position P-1 (FIG. 9) the leading edge portion 65 of the plate 63 is disposed in capping relation with the discharge opening 31. That is, the leading edge portion 65 of the plate 63 engages and deflects the brushes 57, 58 thereby to cap the discharge opening 31. In position P-2 (FIG. 7) the leading edge portion 65 of the plate 63 is laterally spaced-apart from the brushes 57, 58, whereby the granular insulation 25 is free to flow through the discharge opening 31 to fill the cells 18 of the core/sheet unit 26.

Control means, such as a microswitch 74 (FIGS. 7 and 10), is provided for opening and closing the valve means 33. The microswitch 74 has a feeler 75 positioned to be engaged by the core/sheet unit 26.

BRUSH MEANS 35

Figure 11:
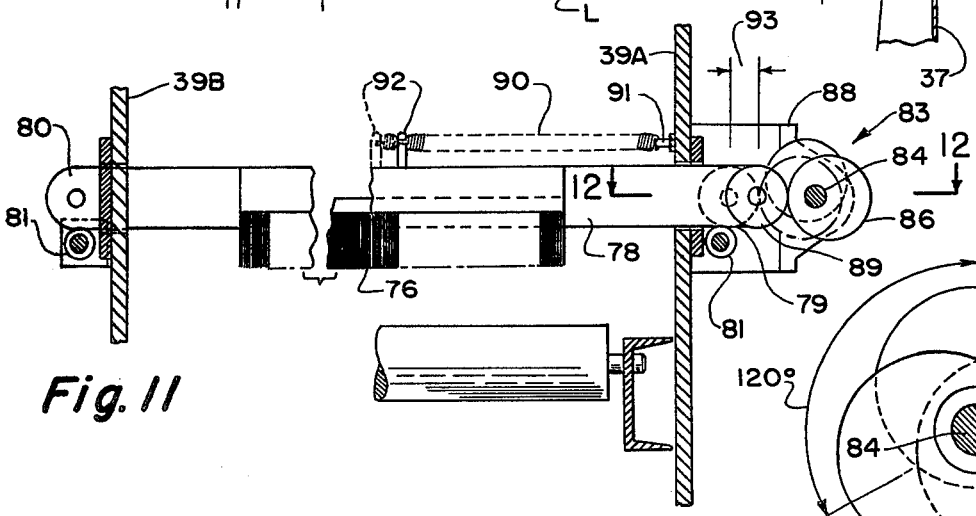
FIG. 11 is a fragmentary cross-sectional view taken along the line 11—11 of FIG. 6.

Referring to FIG. 7, the brush means 35 preferably comprises plural brushes 76 supported such that the lower edges 77 thereof engage the film 19A of adhesive material provided on the upper edges 20 of the cells 18. Each of the brushes 76 is secured to a support bar 78. As best seen in FIG. 11, each of the support bars 78 extends transversely between and through the side plates 39A, 39B and includes opposite ends 79, 80 presented outboard of the side plates 39A, 39B. The opposite ends 79, 80 are supported on rollers 81 which allow the bars 78 to move horizontally.

As best shown in FIG. 3, the brush drive means 36 includes motor means 82 driving cam means 83 which oscillates the brush means 35 transversely of the core member 18.

Figure 13:
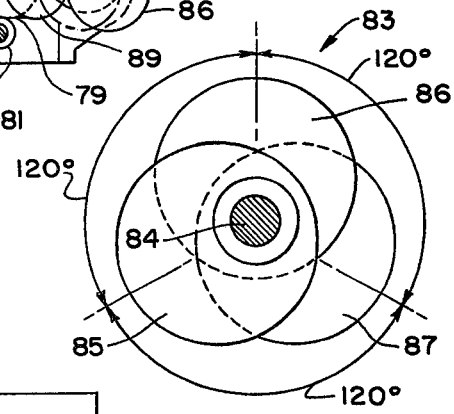
FIG. 13 is a cross-sectional view taken along the line 13—13 of FIG. 6.

Referring to FIG. 13, the cam means 83 includes an axle 84 having plural eccentric cams 85, 86, 87 secured at spaced locations along the length thereof. The cam means 85, 86 and 87 are equiangularly spaced-apart, for example, at 120 angular degrees. The axle 83 is supported at its opposite ends on bearing blocks 88 (FIGS. 3 and 11).

Figure 12:
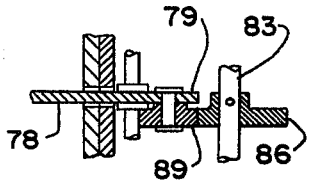
FIG. 12 is a fragmentary cross-sectional view taken along the line 12—12 of FIG. 11.

Referring to FIGS. 11 and 12, the end 79 of each of the support bars 78 rotatably supports a cam follower 89 positioned to engage one of the eccentric cams, for example the eccentric cam 86. A spring member 90, provided for each of the support bars 78, has one end connected to a hook 91 secured to the side plate 39A; and an opposite end connected to a vertical post 92 secured to the support bar 78.

It will be appreciated by inspection of FIG. 11 that as the axle 84 is rotated through one complete revolution, the support bar 78 and the brush 76 is oscillated through a distance indicated at 93. By virtue of the equiangular spacing of the cams 85, 86 and 87 about the axle 84, the brushes 76 are oscillated in fixed out-of-phase relation relative to each other. That is, with respect to any one of the brushes 76, a second brush will lead the first by 120° whereas the third brush 76 will lag the first brush 76 by 120°. Therefore, as the core/sheet unit 26 (FIG. 7) passes beneath the oscillating brushes 76, excess granular insulation is removed from the cells 78 and the film 19A is rendered substantially entirely free of the granular insulation.

ADJUSTING MEANS 40

Figure 5:
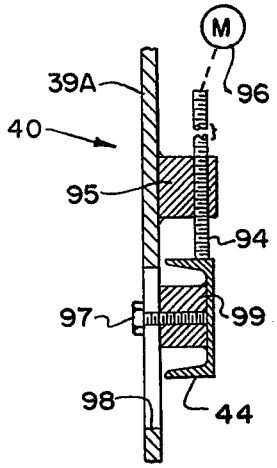
FIG. 5 is a fragmentary cross-sectional view, taken along the line 5—5 of FIG. 3, illustrating adjusting means.

Referring to FIG. 5, each of the adjusting means 40 may comprise a vertically presented leveling screw 94 threadedly engaged in a block 95 which is secured to the side plate 39A. A locking bolt 97 extends through a vertical slot 98 in the side plate 39A and is threadedly engaged in a block 99 presented by the frame member 44. Drive means 96 is arranged to rotate all of the screws 94 in unison. Thus the level of the discharge opening 31 and of the brush means 35 (FIG. 7) is simultaneously adjusted relative to the conveyor means 28, to correspond with the thickness of the core/sheet unit 26. The thickness of the core/sheet unit 26 may range from about one inch to about four inches.

INSULATION SUPPLY AND RECOVERY SYSTEM

Figure 14:
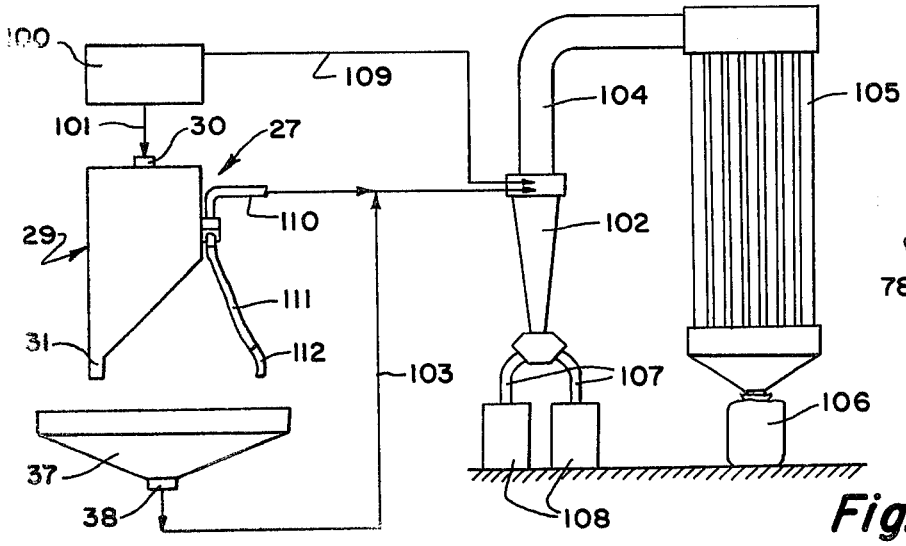
FIG. 14 is an elevation view schematically illustrating a system for recovering excess granular insulation.

The insulation supply and recovery system for the present apparatus 27 is schematically illustrated in FIG. 14. A supply of granular insulation is maintained in a bin 100 and is transferred therefrom, for example, by auger means schematically illustrated by the line 101, to the inlet 30 of the hopper means 29. The excess granular insulation removed from the core member is received in the pan means 37. A cyclone separator 102 provides sufficient suction to convey the excess granular material from the pan outlet 38 through conduit 103 to the cyclone separator 102. In the cyclone separator 102, the fines are separated from the useful granular insulation material. The fines are swept upwardly through conduit 104 to filtering apparatus 105 and are collected in a bag 106 for disposal. The reusable granular insulation material drops downwardly through the cyclone separator 102 and is directed through discharge conduits 107 into receptacles 108. The material in the receptacles 108 is recycled to the supply bin 100. While loading the supply bin 100, fines entrained in the air are captured by the suction conduit 109 and transferred thereby to the cyclone separator 102. A suction conduit 110 also communicates with the suction conduit 103. As best shown in FIGS. 4 and 6, the suction conduit 110 communicates with branch conduits 111 each terminating in a suction nozzle 112. The suction nozzles 112 are adjustably supported and positioned to remove any granular insulation 25 (FIG. 10) which may accumulate on the side rails 23.

The overall arrangement is such that all traces of excess granular insulation are removed from the core/sheet unit 26 as it emerges from the apparatus 27. The brush means 35 not only insure uniform and complete filling of the cells 18 but also renders the film 19A of adhesive material at the upper face thereof substantially entirely free of granular insulation.

I claim:

1. In apparatus for filling cells of an expanded cellular core member with granular insulation, said core member having a base sheet secured to and capping lower ends of said cells, said apparatus including horizontally disposed conveyor means arranged to transport said core member along a rectilinear path of travel, and hopper means positioned above said conveyor means, having a lower discharge opening therein proximate to said conveyor means, the improvement comprising:

adjustable barrier means for adjusting the cross-sectional area of said discharge opening;

valve means controlling the flow of said granular insulation through said discharge opening; and horizontal path means disposed beneath said conveyor means, receiving excess granular insulation from said core member.

2. The improvement of claim 1 wherein said adjustable barrier means resides between said valve means and said discharge opening.

3. The improvement of claim 1 including control means operable by the passage of said core member for opening and closing said valve means.

4. The improvement of claim 1 wherein said valve means comprises:

a plate at least coextensive in area with said discharge opening;

means supporting said plate for swinging movement about an axis spaced from and extending transversely of said conveyor means; and motor means for swinging said plate between a first position wherein said plate is disposed in capping relation with said discharge opening, and a second position wherein said plate is spaced from said discharge opening.

5. The apparatus of claim 1 wherein said discharge opening presents opposite side walls extending transversely of said conveyor means, and opposite end walls; said adjustable barrier means comprising:

fixed barrier members, one extending along and downwardly from each of said opposite side walls;

second barrier members, each extending between said fixed barrier members and downwardly from said discharge opening; and support means supporting each of said second barrier members for horizontal movement toward and away from each other.

6. The apparatus of claim 5 wherein said barrier members comprise brushes.

7. The apparatus of claim 1 including adjusting means for adjusting the level of said discharge opening relative to said conveyor means.

8. The apparatus of claim 7 including side plates, one positioned outboard of each side of said conveyor means, supporting said hopper means; and said adjusting means adjustably supporting said side plates on said conveyor means.

9. In apparatus for filling cells of an expanded cellular core member with granular insulation, said core member having a base sheet secured to and capping lower ends of said cells and having a film of adhesive material provided on upper ends of said cells, said apparatus including horizontally disposed conveyor means arranged to transport said core member along a rectilinear path of travel, and hopper means positioned above said conveyor means and having a lower discharge opening therein proximate to said conveyor means, the improvement comprising:

valve means controlling the flow of said granular insulation through said discharge opening;

brush means positioned downstream of said discharge opening and extending transversely across said conveyor means, removing excess granular insulation from said cells and rendering said film of adhesive material substantially entirely free of said granular insulation; and horizontal pan means disposed beneath said hopper means and said brush means, receiving excess granular insulation from said core member.

10. The improvement of claim 9 including drive means for oscillating said brush means transversely of said core member.

11. The apparatus of claim 9 wherein said brush means comprises:

plural brushes having lower edges positioned to engage the upper ends of said cells;

support means at the opposite sides of said conveyor means, supporting said brushes in spaced-apart generally parallel relation; and drive means oscillating said brushes transversely of said core member.

12. The improvement of claim 9 including control means operable by the passage of said core member for opening and closing said valve means.

13. The improvement of claim 9 including adjustable barrier means for adjusting the cross-sectional area of said discharge opening.

14. The improvement of claim 13 wherein said adjustable barrier means resides between said valve means and said discharge opening.

* * * * *